US006994370B2

(12) United States Patent
Sabol

(10) Patent No.: US 6,994,370 B2
(45) Date of Patent: Feb. 7, 2006

(54) ADJUSTABLE ROTATABLE SPORTS BOARD BOOT BINDING

(76) Inventor: Jeffrey P. Sabol, 235 Osborne Ave., Waterville, NY (US) 13480

( * ) Notice: Subject to any disclaimer, the term of this patent is extended or adjusted under 35 U.S.C. 154(b) by 142 days.

(21) Appl. No.: 10/658,309

(22) Filed: Sep. 9, 2003

(65) Prior Publication Data

US 2005/0051978 A1 Mar. 10, 2005

(51) Int. Cl.
*A63C 9/02* (2006.01)

(52) U.S. Cl. ..... 280/618; 280/636

(58) Field of Classification Search ..... 280/14.21, 280/14.22, 14.24, 617, 618, 623, 625, 626, 280/629, 634, 636

See application file for complete search history.

(56) References Cited

U.S. PATENT DOCUMENTS 5,577,755 A * 11/1996 Metzger et al. ..... 280/607
5,586,779 A * 12/1996 Dawes et al. ..... 280/14.24
5,762,358 A * 6/1998 Hale ..... 280/607
5,803,481 A * 9/1998 Eaton et al. ..... 280/633
6,062,584 A * 5/2000 Sabol ..... 280/607
6,102,430 A * 8/2000 Reynolds ..... 280/618
6,203,051 B1 * 3/2001 Sabol ..... 280/607
6,234,494 B1 * 5/2001 Gien ..... 280/14.24
6,318,749 B1 * 11/2001 Eglitis et al. ..... 280/607
6,450,511 B1 * 9/2002 LaVoy ..... 280/14.22
6,491,310 B1 * 12/2002 Work ..... 280/14.24

FOREIGN PATENT DOCUMENTS

CH 678278 * 8/1991
JP 2000-70432 * 3/2000
WO 96/12532 * 5/1996

* cited by examiner

*Primary Examiner*—Frank Vanaman
(74) *Attorney, Agent, or Firm*—Lathrop & Gage LC

(57) ABSTRACT

A base plate with a ring of holes is secured to any existing sports board. A flat rotatable plate, supporting a board boot binding, has a two-position spring-loaded locking shaft which locks down in one of the holes to secure the boot binding at a desired stationary angle and alternately locks up out of the holes for free rotation. A semicircular arc in one plate dividable into two smaller arcs by a movable stop limits rotation of a safety pin from the other plate alternately to one or the other of the smaller arcs. A downwardly extending ridge around the periphery of the rotatable plate overlaps the base plate. There is a low friction surface between the two plates, an inner grease ring to keep dirt out of the inner shaft, a leash hole and leash on the L-shaped locking mechanism to aid in its operation, and a rotatable position indicator that aids the user in locating their desired angular position, an elevated lock ring to prevent icing or water buildup in the locking holes, and a series of holes in the base plate that allow the user to preset the amount of desired rotation between the plates.

15 Claims, 5 Drawing Sheets

ADJUSTABLE ROTATABLE SPORTS BOARD BOOT BINDING

BACKGROUND OF THE INVENTION

1. Field of the Invention

The present invention relates to bindings for sports boards, and in particular to an adjustable rotatable binding which is adjustably configured to retrofit any of a variety of standard sports board boot bindings, such as snowboards which is compatible for use in sky, ground, water, ice,.and ski board sports and related extreme sports boards including, for example, water and snow skis and boards, wakeboards, skateboards, surfboards, and sailboards, and skateboard-type devices adapted for use on ice surfaces, and which adjustable rotatable binding may be both locked in a stationary position marked by a rotation position indicator and locked in a free rotation condition and which has a safety rotation limit track which has two separate rotation ranges (0–90 degrees and 90–180 degrees).

2. Description of the Prior Art

Snowboard boot bindings and bindings for other sports boards are normally screwed onto the board in a permanent orientation which is almost perpendicular to the direction of travel of the board. This orientation is good for riding downhill on the board, but is very uncomfortable when traveling over a flat or uphill snow contour, when it is necessary to release the back boot and use that boot to propel the board. Having the front boot nearly perpendicular to the board with the board and back foot moving straight forward is very uncomfortable and potentially dangerous because a fall in this orientation may injure the ankle or knee joints of the boarder. Furthermore on a chairlift having the foot nearly perpendicular to the board causes the board to be positioned across the front of the chair which is an awkward orientation for mounting and dismounting and is disturbing or damaging to anyone seated on an adjacent chair. Mounting and dismounting the chairlift poses a serious danger for potential injury with the foot oriented nearly perpendicular to the board.

It is desirable to be able to change the orientation of the board boot binding when traveling on flats and uphills and when mounting and dismounting a chairlift to orient the front boot parallel to the board for ease in propelling the board forward with the rear boot, which is released from the binding.

It is also desirable to be able to adjust the angle of the board boot binding to any desired orientation to the board to adapt to individual preferences for best downhill boarding performance and to accommodate different snow and terrain conditions. For example, a nearly perpendicular orientation of the boots may be better for moguls or boarding down narrow trails where tight fast turns are required, while a slightly more forward orientation of the boots may be more desirable for broad sweeping turns down a wide slope. In addition, a boarder may prefer to be able to adjust the rear boot at a different orientation from the front boot, particularly for stunt boarding.

It is further desirable to be able to adjust a board fitting to receive any of a variety of existing board boots and bindings.

A number of prior art devices have provided rotatable board bindings, but lack the improved performance and ease of adjustability of the present invention.

Prior art U.S. Pat. No. 5,577,755, issued Nov. 26, 1996 to Metzger et al., provides a rotatable binding for a snowboard with a base plate on the snowboard and a binding plate and foot binding rotatably mounted on top of the base plate with a locking assembly for selectively locking the binding plate to the base plate at any desired angle. The top of the base plate has an indexing platform with a circular series of bores to receive a spring-loaded pin (or two pins) with a large loop for locking the binding plate in position. Indexing markers on the base plate align the pin or pins with the holes of the base plate. The Metzger patent does not have a secure screw-type up and down locking device, a retrofit capability, roller bearings, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 4,964,649, issued Oct. 23, 1990 to Chamberlin, shows a snowboard boot binder which allows the rider to rotate his boots while riding the snowboard. It has two base plates secured to the board and two plates with boot binders rotatably connected to the base plates. Springs between each rotating plate and each base plate limit relative motion therebetween and bias the rotating plates to return to the original angle of orientation after the rider rotates the plates. The Chamberlain patent does use ball bearings. The Chamberlin patent does not have a secure screw-type up and down locking device, a retrofit capability, an elevated lock nng to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,586,779, issued Dec. 24, 1996 to Dawes et al., claims an adjustable snowboard boot binding apparatus which is rotatably adjustable "on the fly" without removing the boot from the binding and is compatible with existing snowboard boot bindings. A central hub is attached to the board and a top binding mounting plate and bottom circular rotating plate are interconnected and sandwich the hub between them, so that the binding plate and circular plate rotate on a bearing between the binding plate and the central hub. No snow or ice may penetrate to the hub. A spring-loaded plunger lock mechanism locks the binding plate to the central hub in a series of holes in the hub. Alternately, gear teeth on the hub may interact with a plunger to lock the device. Several other locking devices are shown. The Dawes patent does not have a secure screw-type up and down locking device. The Dawes patent does have a retrofit capability. The Dawes patent does not provide an elevated lock ring to prevent icing, a central guide post for ease of alignment during assembly, a positive engagement safety device to limit the degree of rotatability during free rotation, or an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,028,068, issued Jul. 2, 1991 to Donovan, describes a quick-action adjustable snowboard boot binding comprising a support plate to which a conventional boot binding is mounted. The support plate is fixedly attached to a circular swivel plate which rotates, via a center bearing, relative to a base plate attached to the board. A cable encircles a groove in the swivel plate and a handle pivots up to release the cable for adjusting the angle of the swivel plate and pivots down to tighten the swivel plate at a desired angle. Both boot bindings are angularly adjustable. The Donovan patent does not have a secure screw-type up and down locking device and does not have retrofit capability to fit any existing binding, and does not have an elevated lock ring to prevent icing, a central guide post for ease of alignment during assembly, a positive engagement safety device to limit the degree of rotatability during free rotation, or an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,261,689, issued Nov. 16, 1993 to Carpenter et al., discloses a snowboard binding system utilizing a binding plate supported on the snowboard with a circular disk-shaped hold-down plate over the binding plate. The binding plate rotates relative to the hold-down plate, which each have ribs or ridges which interact to lock the rotational position of the binding plate. The boot must be removed and attaching screws loosened to change the angular orientation. Both bindings are rotatable. The Carpenter patent does not have a secure screw-type up and down locking device and does not have retrofit capability. Further, Carpenter lacks roller bearings, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,553,883, issued Sep. 10, 1996 to Erb, indicates a snowboard binding which permits angular reorientation of a user's foot while maintaining that foot attached to the snowboard and utilizes a footplate that is rotatably connected in close proximity to the snowboard by a circular anchor plate. A pair of spring biased pins inserted in a circular array of holes in the snowboard lock the footplate at any desired angle. Both bindings are rotatable. The Erb patent does not have a secure screw-type up and down locking device, a retrofit capability, roller bearings, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,354,088, issued Oct. 11, 1994 to Vetter et al., puts forth a coupling for releasably mounting a boot with boot binding to a turntable ring which is adjustably secured to a snowboard. A spring loaded pin with a long cord is the locking mechanism. The Vetter patent does not have a secure screw-type up and down locking device, a retrofit capability, roller bearings, an elevated lock ring to prevent icing, a central guide post for ease of alignment during assembly, a positive engagement safety device to limit the degree of rotatability during free rotation, or an easy grasp elevated L-shaped lock handle for use with gloves or mittens, or a rotation position indicator for use with the graduated increment sticker, or a top plate overhang to keep dirt out, or an inner grease ring to keep dirt out of the inner shaft, or a series of angle set screws.

Prior art U.S. Pat. No. 5,667,237, issued Sep. 16, 1997 to Lauer, concerns a rotary locking feature for a snowboard binding allowing rotation of a snowboard binding relative to the snowboard without removal of the binding from the boot. It utilizes a releasable latch integral with the binding to disengage a rotatable locking mechanism having a stationary circular hub notched around the perimeter with a spring-loaded pointer engaging the notches to lock the rotating binding in place at a desired angle. The Lauer patent does not have a secure screw-type up and down locking device, a retrofit capability, roller bearings, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,499,837, issued Mar. 19, 1996 to Hale et al., illustrates a swivelable mount for a snowboard having a rotatable binding plate attached to a circular plate which rotates in a circular groove of a base plate secured to the snowboard. A handle with a cam and spring-loaded pin secures the binding plate at a desired angle. The Hale patent does not have a secure screw-type up and down locking device, a retrofit capability, roller bearings, an elevated lock ring to prevent icing, a central guide post for ease of alignment during assembly, a positive engagement safety device to limit the degree of rotatability during free rotation, or an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 4,728,116, issued Mar. 1, 1988 to Hill, is for a releasable binding for snowboards having a ring secured to a snowboard and a block rotatably mounted on the ring with boot-engaging plugs at each end of the block. A spring-loaded double pin locking system is operated by a handle to move both pins simultaneously for locking the binding at a desired angle. The Hill patent does not have a secure screw-type up and down locking device, a retrofit capability, roller bearings, an elevated lock ring to prevent icing, a central guide post for ease of alignment during assembly, a positive engagement safety device to limit the degree of rotatability during free rotation, or an easy grasp elevated L-shaped lock handle for use with gloves or mittens or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 4,871,337, issued Oct. 3, 1989 to Harris, provides a binding for a snowboard (and water ski board) with longitudinal and angular adjustment. Riding plates move along a channel running down the center of the board traveling on a pivotable connector riding in the channel locked in place by a thumbscrew. The Harris patent does not have a secure screw-type up and down locking device, a retrofit capability, roller bearings, an elevated lock ring to prevent icing, a central guide post for ease of alignment during assembly, a positive engagement safety device to limit the degree of rotatability during free rotation, or an easy grasp elevated L-shaped lock handle for use with gloves or mittens or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,584,492, issued Dec. 17, 1996 to Fardie, provides an adjustable snowboard binding assembly which can be rotatably controlled without the use of external tools. The snowboard mounting platforms each have a plurality of inwardly facing radial teeth along the circumference of a centralized circular cutout, the bottom of which rests on four quadrant segments connected to a stainless steel band which moves along a groove in the center of the board activated by a lever. The mounting platform can rotate relative to the four quadrant segments and is locked in place at a desired angle by two spring loaded sliding segments with mating teeth to engage the teeth on the mounting platform to lock it in place at a desired angle. The Fardie patent does not have a secure screw-type up and down locking device, a retrofit capability, roller bearings, an elevated lock ring to prevent icing, a central guide post for ease of alignment during assembly, a positive engagement safety device to limit the degree of rotatability during free rotation, or an easy grasp elevated L-shaped lock handle for use with gloves or mittens or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Patent Application #20020140208, published Oct. 3, 2002 by Duvall, puts forth a boot and binding rotation apparatus, which is compatible for use in sky, ground, water, ice, and ski board sports and related "extreme" sports. The apparatus is preferably used with boards, skis, and comparable items including, for example, water and snow skis and boards, wakeboards, skateboards, surfboards, and sailboards, and skateboard-type devices adapted for use on ice surfaces. The boot and binding rotation device includes a base plate that has a stance adjust key assemblage and a ring mount flange. The base plate preferably receives a hole pattern for mounting to the sporting device. A retainer ring is mounted about or to the base plate and is formed with a retainer race surface about an interior circumference. The retainer ring rotatably captures a rotator disk. The disk is preferably formed with a stance adjuster receiver and a rotator race surface. The race surface is adapted to cooperate with the retainer race surface to form a circumfluent raceway, which can be a scarf or half lap butt splice joint. The rotator disk is further sized and adapted to substantially cover and protect the base plate from the elements and to receive a footgear mounting hole pattern, which mounts the binding or footgear worn by the user. Preferably, the receiver releasably captures a stance adjuster, which can be a quick-release-type pin, that is adapted to engage the stance adjust key assemblage to relatively and adjustably fix the rotator disk relative to the base plate. The Duvall patent application does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Patent Application #20030038455, published Feb. 27, 2003 by Lett, concerns a swivel mount for a board binding, which includes a base mountable to an upper surface of a board, and a swivel plate rotatably mounted on the base for relative swiveling rotation of the swivel plate relative to the base between a ride position and forward-walking positions. When the swivel plate is in the ride position the binding is oriented generally perpendicularly to a longitudinal axis of the board. When the swivel plate is in the forward-walking positions, the binding is oriented to point a user's forward foot in the binding toward a front end of the board, so as to generally form an acute angle between the binding and the longitudinal axis of the board. A rotational resistance device cooperates between the swivel plate and the base for increasing rotational resistance above that of free-floating rotation but without locking of the swivel plate in a preset locking position when swiveling the swivel plate through the radial arc of the forward-walking positions. A ride position latch releasably locks the swivel plate in the ride position relative to the base upon rotational urging by the user's forward foot so as to return the swivel plate from the forward-walking position to the ride position. An actuator releases the ride position latch when actuated by a force applied in a first direction urging the swivel plate to swivel from said ride position to the forward-walking positions. The Lett patent application does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Patent Application #20030090072, published May 15, 2003 by Cole, illustrates a freely rotatable binding base assembly for use on a board used in single-board sports such as snowboarding and slalom water skiing. A binding assembly mounted on and movably secured to the board, and is adapted to receive a conventional boot as worn by a rider. Additional features include a locking means for selectably blocking rotation, and a clutch for braking rotation by applying side loading to the board. The Cole patent application does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Patent Application #20030132610, published Jul. 17, 2003 by Miotto, is for a device for fixing a boot attachment base to a snowboard. The device includes a base with a seat housing a first disc, the disc and seat have cooperating teeth. The first disc includes a rim defined about its upper surface, multi-lobed holes or apertures, and a centrally located slotted hole extends through the first disc. A second, smaller disc fits within the rim on the first disc, the second disc includes a centrally located slotted hole and multi-lobed holes. The slotted holes in the discs are disposed perpendicular to one another, the multi-lobed holes are aligned, and a locking assembly, including a parallelepiped block, fits within the holes and engages them simultaneously. A square nut, screw, and washer, complete the locking assembly for the pair of discs. The Miotto patent application does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Patent Application #20030057679, published Mar. 27, 2003 by Pollmiller, depicts a snowboard with a rotatable mount securing a binding thereon. The mount includes a base member affixed to the snowboard by fasteners that extend through positioning holes. A coupling member is rotatably disposed in the base member and includes openings to fasten the binding to it. A latch operates to lock and unlock the rotation of the coupling member so that the rider may orient the boot with respect to the board's longitudinal axis. When locked, the boot's longitudinal axis is generally transverse to the board's longitudinal axis in a primary boot position. When unlocked, the rider can rotate the boot so that its longitudinal axis is generally parallel to the board's longitudinal axis in a secondary boot position. A snowboard that has first and second bindings is provided with the mount's coupling member attached to the second binding. A method for supporting a binding on a snowboard is also provided. The Pollmiller patent application does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 6,575,489, issued Jun. 10, 2003 to White, provides a snowboard rotatable binding conversion apparatus, which is inserted between and attaches to a snowboard and a boot binding to render the boot binding rotatable in relation to the snowboard. The snowboard rotatable binding conversion apparatus includes a base, an engaging plate that sandwiches the base between the engaging plate and a snowboard, a top plate that sandwiches the engaging plate between the top plate and the base, an engaging element that engages an engaging slot in an engaging plate, an engaging bar that movably secures the engaging element to the base, a tension bar that provides tension to the engaging element, a tether attachable to the engaging element, and a plurality of screws and screw-receiving holes to attach the engaging bar to the base, the engaging plate to the snowboard, and the top plate to the base. The White patent does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 6,450,511, issued Sep. 17, 2002 to LaVoy, shows a swivelable mount for the boot bindings of a snowboard or walceboard or the like that includes a low profile top plate with a downwardly extending circular outer wall which screws down onto matching threads on the outer edge of a circular bottom plate, which attaches to a snowboard. The top plate provides an inner-facing threaded flange positioned opposite the outward-facing threaded surface of the bottom plate, and prevents upward movement of the top plate from the snowboard, thereby keeping the snowboard rider firmly attached to the snowboard. The two plate surfaces are slideable on each other when a spring pin, mounted to the top plate and extending through a hole in the bottom plate, is drawn upwardly, corresponding to an unlocked, rotatable condition of the top plate allowing the upper surface to rotate to another position as determined by the placement of the holes. When the spring-loaded pin is released, the pin engages the opposing bottom plate hole and prevents the top plate from rotating. The LaVoy patent does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or an inner grease ring to keep dirt out of the inner shaft, or a series of angle set screws.

Prior art U.S. Pat. No. 6,318,749, issued Nov. 20, 2001 to Eglitis, claims an angularly adjustable snowboard binding mount and method of adjusting such that utilizes a position altering plate, which is fixedly mounted onto a snowboard. A baseplate is mounted on the position altering plate and is pivotally movable from a locked position to an unlocked position with the unlocked position being substantially ninety degrees from the locked position. The locked position locates the longitudinal axis of the boot binding substantially at ninety degrees relative to the longitudinal center axis of the snowboard. The unlocked position locates the longitudinal axis of the boot binding substantially in alignment with the longitudinal center axis of the snowboard. In the second embodiment of this invention, the boot binding is mounted on an adjustment plate, which is mounted in conjunction with the baseplate. The position of the adjustment plate can be adjusted relative to the baseplate so as to accommodate to different initial mounting positions of the boot binding relative to the snowboard according to the desires of different riders. The Eglitis patent does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,984,346, issued Nov. 16, 1999 to Keller, indicates a binding for a snowboard or the like that includes a base plate, which has a central opening and a fastening plate located inside the central opening. The fastening plate is held to the board by fasteners, which can be moved to different holes in a pattern of holes. A flange plate and a clamping disk are retained to the fastening plate by screw connection sleeves threaded into threaded bolt holes located on the fastening plate. A spring located on the fastening plate tries to lift the flange plate and the clamping disk in the vertical direction. The clamping disk includes arcuate concentric slots having a ramp-like bearing surface conforming to heads on the screw connection sleeves having convex undersides. The clamping disk has a first rotational position and a second rotational position. The first rotational position forces a toothing arrangement located at the peripheral outer edge of the flange plate to engage a mating toothing arrangement on the base plate and holding the base plate in a non-rotatable position. The second rotational position causes the toothing arrangement in the flange plate to disengage the toothing arrangement in the base plate allowing the base plate to rotate. The Keller patent does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 6,206,402, issued Mar. 27, 2001 to Tanaka, puts forth a snowboard binding adjustment mechanism for adjusting the angular orientation of a snowboard boot relative to a snowboard. The snowboard binding adjustment mechanism can be rotated and locked at various angles relative to the snowboard without the need for tools. The snowboard binding mechanism basically has an adjustment disk adapted to be fixedly coupled to the upper surface of a snowboard, and a base plate having an opening with the adjustment disk positioned therein. A control assembly is formed between the adjustment disk and the base member for locking and unlocking the base plate relative to the adjustment disk. In particular, locking members are movably arranged relative to the adjustment disk and the base plate for engaging internal circumferential teeth formed along the opening of the base plate. A control member is secured for moving the locking members between the locked position and the released position. The control member in selected embodiments is rotatably coupled to the adjustment disk and operatively coupled to the locking members to move the locking members between locked positions and release positions. In one embodiment, a pair of links interconnect the control member to the locking members. In another embodiment, a cam member is utilized to engage the locking members for moving them between the locked positions and the release positions. In one of the embodiments, biasing members or springs are utilized to hold the locking members normally in a locked position. The Tanaka patent does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,765,853, issued Jun. 16, 1998 to Erb, concerns a snowboard binding that permits angular reorientation of a user's foot while maintaining that foot attached to the snowboard. A binding that attaches a user's foot to a snowboard includes a footplate that is rotatably and continuously fixed to the snowboard and which is attached to the user's foot via straps and a rear support which contact a snowboot. An anchor fixes the footplate to the snowboard with the bottom of the footplate as close to the snowboard as possible whereby the bottom of a snowboarder's foot is as close to the plane of the snow as possible, and is slidably engaged with the footplate to permit that footplate to rotate while remaining attached to the snowboard. Anti-pivot spring pins located outside the outer perimeter of a user's snowboot accurately and repeatably secure the footplate to the snowboard once the footplate is in the selected angular orientation on the snowboard. A top plate includes a plurality of pin-receiving holes defined therein for receiving the spring pins. The anchor includes a top plate, which is slidably connected to the footplate by an annular flange on the footplate fitted beneath an annular flange on the top plate. The Erb patent does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 6,155,578, issued Dec. 5, 2000 to Patterson, illustrates a mount for securing a boot binding to a snowboard for permitting the binding to be easily rotated between a user-preferred snowboarding orientation preset by the binding, to an orientation approximately parallel to the snowboard's longitudinal axis, and to conveniently and accurately return the binding to its original preset snowboarding orientation. The Patterson patent does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,826,910, issued Oct. 27, 1998 to Ricks, is for a swivelable bindings assembly for a snowboard, for selective rotational adjustment of the bindings about an axis normal to the upper surface of the snowboard. The assembly includes a rotatably adjustable bindings plate that has a bottom surface, an upper portion adapted for releasably supporting a user's boot, and a relatively large diameter circular opening in the central portion of the plate. The assembly includes a holds-down disk that is received in the plate opening and is adapted to slidably engage edge portions of the plate opening to restrain the plate against upward separation from the disk and to hold the plate with its bottom surface slidably engaged with, and vertically supported by, the low-friction planar surface of a sheet of material secured to the top of the snowboard. The disk also serves to mount the plate for rotation about an axis through the center of the disk. Mechanism for releasably locking the plate at selected rotational positions includes a locking pin with an elongate shaft that engages a horizontal bore extending from an edge of the base plate to the base plate opening, the plate being rotatable to bring the bore in alignment with at least one recess in the outer edge of the disk whereby the pin shaft can be engaged in a selected recess to secure the plate against rotation. The Ricks patent does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

Prior art U.S. Pat. No. 5,803,481, issued Sep. 8, 1998 to Eaton, provides a snowboard that is provided with front and rear foot mounts. The front foot mount is mounted for rotation or pivotable movement about an axis. It is lockable into a number of rider selected azimuthal positions on the snowboard. Foot rotation can be used to move it between some positions. In other positions, the front foot mount is locked in position and cannot be moved to a new position without the rider first pulling on a pull line, to unlock the front foot mount from the snowboard. The rear foot mount is a step-in step-out mount. The rider can step in at a number of different azimuthal positions, selected by the rider. In each position, the rear foot mount is moved by rotation into a position where it is locked to the snowboard. A pull line is used to unlock the rear mount front of the board, so that the rider can rotate his/her rear foot into a step-out position. The Eaton patent does not have a secure screw-type up and down locking device, an elevated lock ring to prevent icing, a central guide post for ease of alignment during assembly, a positive engagement safety device to limit the degree of rotatability during free rotation, an easy grasp elevated L-shaped lock handle for use with gloves or mittens, or a rotation position indicator for use with the graduated increment sticker, or an L-handle leash hole and leash, or a top plate overhang to keep dirt out, or an inner grease ring to keep dirt out of the inner shaft, or a series of angle set screws.

None of the prior art enable a secure locking of the snowboard boot binding in either the hold down position or the freely rotating position. They require holding the locking mechanism to allow rotation and releasing the locking mechanism to lock it by spring action or friction.

None of the prior art devices provide an advertising or identification plate combined with the snowboard binding.

None of the prior art devices provide an adjustable means to allow a rotatable binding apparatus to be used with any of a variety of existing snowboard boots and bindings having two 90 degree rotation modes.

None of the prior art devices provide a top plate overhang to keep dirt out.

None of the prior art devices provide an inner grease ring to keep dirt out.

None of the prior art devices provide an elevated lock ring to prevent ice from collecting in the holes used for the locking mechanism.

None of the prior art devices provide a rotation position indicator for use with a graduated sticker.

None of the prior art devices provide an L-handle with a leash hole and a leash to adjust the angle of rotation from a standing position.

None of the prior art devices provide a series of angle set screws to pre-set the amount of rotation available between the top plate and the bottom plate.

SUMMARY OF THE INVENTION

A primary object of the present invention is to provide a rotatable board boot binding device which is compatible for use in sky, ground, water, ice, and ski board sports and related extreme sports and is preferably used with boards, skis, and comparable items including, for example, water and snow skis and boards, wakeboards, skateboards, surfboards, and sailboards, and skateboard-type devices adapted for use on ice surfaces with adjustable means to receive any of a variety of differently sized and differently shaped board boots and bindings and hold the bindings to a rotatable plate with a secure fit to enable rough handling in operation but with a means for easily securing any of a variety of bindings to the rotatable plate and easily removing them.

Another primary object of the present invention is to provide a retrofit device adapted to existing boards and existing board boot bindings which retrofit device converts the existing board boot binding into a rotatable board boot binding which has a locking mechanism for locking the binding in a stationary position or locking the binding in a rotatable position. Locking the mechanism in the up position allows hands-free rotation of the board boot binding while standing upright or with bent knees in the downhill position to insure the exact angle of orientation of the boot binding with the board. Locking the mechanism in a down position engaging the locking ring hole with the locking mechanism with the board boot binding in any desired angular orientation to the board insures that the boot will not slip out of the desired position for downhill boarding with both feet angled, or for level and uphill propelling with one foot aligned with the board and the other free. On the ski lift one boot is locked securely at a comfortable and safe straight alignment with the board for ease and safety of mounting and dismounting and trouble-free straight orientation while riding the lift.

A related object of the present invention is to provide a spring loaded locking mechanism for ease of insertion with the spring biasing the mechanism in the locked orientation for ease of insertion. The spring loaded locking mechanism may be employed in the up (unlocked) position, or in the down (locked) position.

A third object of the present invention is to provide an elevated L-handle on the locking shaft, which handle protrudes vertically for ease of grasping and operation with a gloved or mittened hand.

Another object of the present invention is to provide a Teflon® ring(s) or a number of Teflon® pucks within indented openings in one of the plates to allow for a free and easy rotation of the boot binding relative to the board.

One more object of the present invention is to provide a retrofit device to convert an existing board boot binding into a rotatable board boot binding, which retrofit device has the screw hole configurations to adapt to the commonly used boards and board boot bindings so that the existing bindings are merely unscrewed, the device of the present invention is secured to the board with 3 or 4 screws. The existing binding is then placed over the device and 3 or 4 additional screws then secure the cap plate and existing binding to the top plate.

Another object of the present invention is to provide the rotatable plate with a downwardly extending guide post in the center of the rotatable plate, the guide post fitting rotatably within a center opening in the base plate and retained rotatably therein by a C-clip in a circular slot adjacent to the end of the guide post on the underside of the base plate.

A related object of the present invention is to provide a flat top surface on the rotatable plate to which any existing board boot binding may be attached by screw means or other attaching means.

Yet another object of the present invention is to provide a positive engagement safety device in the form of a pin on one plate and a mating 180 degree arc of a circular groove on the adjacent plate, one of which plates is rotatable relative to the other, and provide a spring-loaded divider pin to limit the degree of rotatability during free rotation to an arc of about 90 degrees on either side of the divider pin, thereby preventing injuries which might occur if the foot were capable of rotating further. It will also aid the board rental companies in switching settings more easily not only for the individual user, but also between left and right footed riders (0–90 and 90–180 degrees respectively).

An added object of the present invention is to provide a labeling surface on the rotatable plate for advertising information, such as a name and phone number of the manufacturer of the device, or for engraving the name of the owner or any other desired information thereon.

Another object of the present invention is to provide an elevated lock ring to prevent water from being able to collect and freeze in the locking holes.

Another object of the present invention is to provide an L-handle with a leash hole and leash to allow upright adjustment of the angle or release.

Another object of the present invention is to provide a rotation position indicator for use with a graduated sticker to allow the user to easily return to a desired angular setting.

Another object of the present invention is to provide a top plate overhang to keep dirt out.

Another object of the present invention is to provide an inner grease ring to keep dirt out of the inner shaft.

Yet one more object of the present invention is to provide a series of angle set screw holes around the periphery of the base plate which enables a user to position a set screw in one or more of the holes so that the set screw screws into the semicircular arc to allow presetting of the amount of desired rotation between the plates.

In brief, the top plate has a downwardly protruding post to mate with the circular opening of the base plate. After the post is inserted through the base plate opening a C-clip slides into a circular groove in the post and locks the two plates together. Once this has been done the bottom plate is then secured to the board via screws or bolts that fit through holes in the top plate and into recessed holes in the bottom plate. The rotatable plate has a means, such as a series of threaded openings, to receive any of a variety of sizes and shapes of standard board boot bindings screwed onto the rotatable plate. The rotatable plate has an outer rim extending downwardly from the outer perimeter of the plate to cover the base plate below and keep out snow and ice.

A cap plate having similar mating holes and bolts or screws is screwed through the cap plate holes and into the top plate. The interlocking teeth between the cap plate and the binding keep the binding securely mounted to the top plate.

A low friction surface or roller bearings positioned between the top plate and the base plate facilitate the ease of rotation of the integrated rotatable plate and boot binding.

A screw-type locking mechanism on the rotatable plate has an upwardly protruding L-shaped handle which is easy to grasp and operate with mittens or gloves. A spring-loaded post with an L-shaped handle fits within a locking ring formed by a circular ring having an angled top surface with a notch at the high end of the angled top surface. In the locked down position, the handle rests at the low end of the angled surface biased downwardly by the spring so that the post engages both the rotatable plate and the base plate and rotation is prevented. Alternately the L-shaped handle is turned 180 degrees moving the handle up the angled surface to the top where the protruding tab of the L-shaped handle rests in the recessed notch at the top of the angled surface, thereby locking the post up out of engagement with the base plate so that the rotatable plate is free to rotate.

A positive engagement safety device comprises a pin on either the rotatable plate or the base plate engaging a mating arc of a circular groove on the other plate. The arc is preferably 180 degrees with a spring-loaded sliding lock in the middle to limit the rotation to an arc of 90 degrees on one side of the sliding lock, which can slide in to allow the pin to rotate alternately into the other 90 degree arc on the other side of the sliding lock. Having the pin stopped at each end of the safe arc of 90 degrees prevents injuries which might occur if the foot were capable of rotating further.

One advantage of the present invention is that it securely and removably holds any of a variety of snow board boot binding sizes and shapes and allows rotation of the board binding without horizontal movement.

Another advantage of the present invention is that a board boot binding is easily rotatable by the boarder in any position, standing or kneeling or whatever, without the need for the boarder to hold onto the lock mechanism while rotating the boot binding. This enables the boarder to adjust the angle of the binding to the exact angular orientation desired for different positions of performance and different snow conditions. It enables the boarder to make the adjustments while on the slope or the flat on the lift or on the fly.

An additional advantage of the present invention is to the board rental companies due to the present inventions' ability to change angles and basic foot orientation (0–90 or 90–180 degrees) for various riders very quickly.

Yet another advantage of the present invention is that ice and snow is blocked from getting in-between the two plates so that the lock mechanism always operates easily and smoothly with the lock shaft sliding easily into the lock holes.

Still another advantage of the present invention is that the large upwardly protruding L-shaped handle is easily gripped and operated by the board with mittens or gloves on.

An additional advantage of the present invention is that the elevated lock ring prevents icing of the lock holes by allowing water and ice to exit from the locking holes, should any start to collect.

A corollary advantage of the present invention is that the pivot-type lock locks securely without danger of the lock shaft being knocked out of the lock holes by rough operation of the board and the large L-shaped handle provides the leverage to enable the boarder to turn the lock mechanism to either lock position easily. Having a spring biasing the lock shaft in a downward position of a sloping surface or into a notch further insures a secured locked engagement of the shaft in either the up or down position.

An additional advantage of the present invention is that it may be retrofit to any existing board to convert an existing board with stationary boot bindings into a board with one or two rotatable adjustable boot bindings.

One more advantage of the present invention is that it is easily and accurately installed with mating holes aligning the base plate with the board requiring only 3 or 4 screws to secure the device to the board, and 3 or 4 additional screws to mount the boot binding to the device.

Yet another advantage of the present invention is that using Teflon® rings or pucks allows very easy rotation of the boot binding.

Still another advantage of the present invention is that having a positive engagement safety limit of rotation of the boot permits free rotation of the boot without danger of rotating too far to create an injury and with the sliding lock permits two alternate safe rotation tracks.

A further advantage of the present invention is that it provides an advertising or name plate surface clearly visible on the top of the rotatable plate opposite of the locking mechanism.

A further advantage of the present invention is that it allows the user to easily return to a desired angle.

A further advantage of the present invention is that it allows the rider to unlock their binding to allow rotation without having to bend all the way down to the binding.

A further advantage of the present invention is that it keeps dirt out of the chamber between the plates.

A further advantage of the present invention is that it keeps dirt out of the center pin.

One more advantage of the present invention is that it allows presetting of the desired amount of rotation between the plates.

BRIEF DESCRIPTION OF THE DRAWINGS

These and other features, objects and advantages will be understood or apparent to those of ordinary skill in the art from the following detailed description of the preferred embodiment as illustrated in the various drawing figures, in which.

BEST MODE FOR CARRYING OUT THE INVENTION

Figure 1:
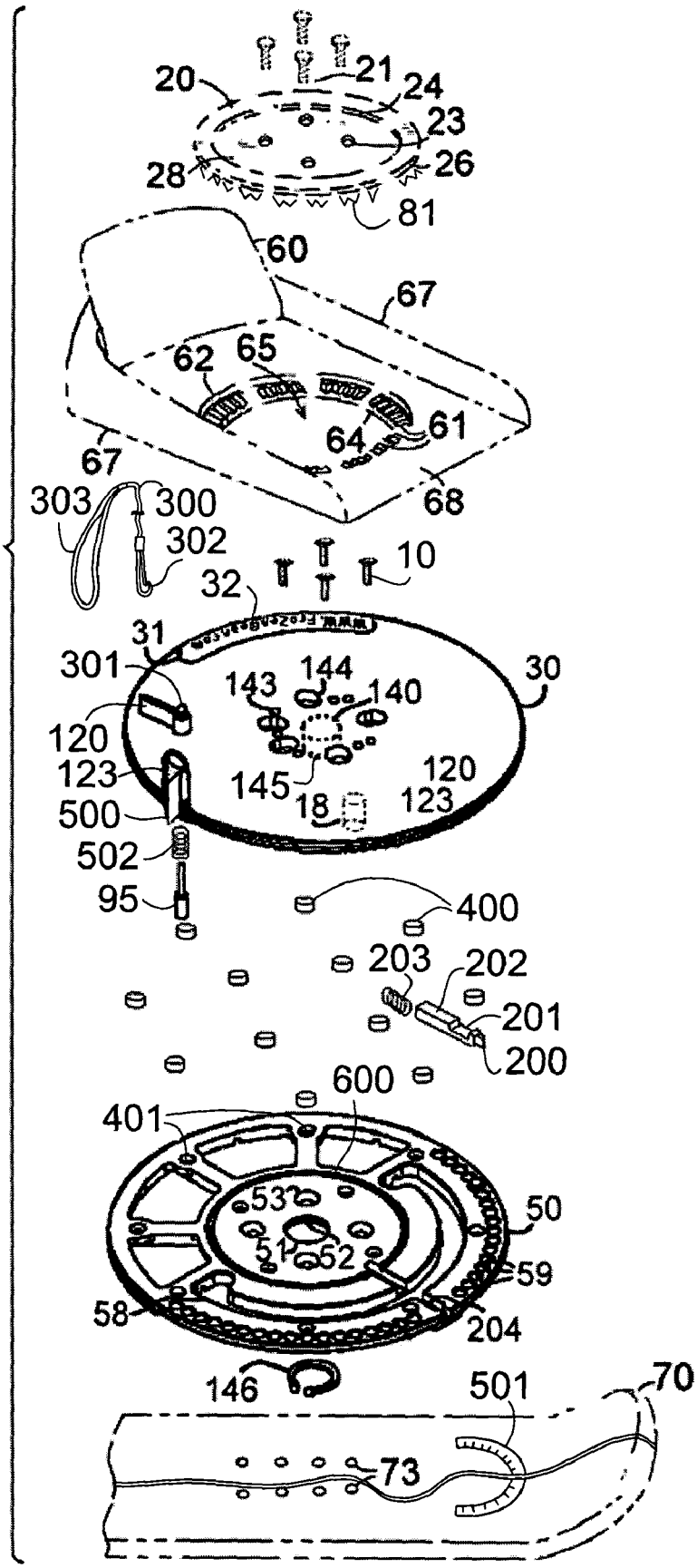
FIG. 1 is an exploded perspective view showing the components of the invention aligned for assembly with the existing board and existing board boot binding.

In FIGS. 1–9, the invention comprises a rotatable sports board boot binding device which is compatible for use in sky, ground, water, ice, and ski board sports and related extreme sports and is preferably used with boards, skis, and comparable items including, for example, water and snow skis and snowboards, wakeboards, skateboards, surfboards, and sailboards, and skateboard-type devices adapted for use on ice surfaces and herein is illustrated by adaptation to an existing snowboard. The rotatable sports board boot binding device has a pair of rigid plates which may be retrofit to a standard board 70 (shown dashed) and a standard board boot binding 60 (shown dashed). A base plate 50 is adapted to be secured to the board 70 with mating holes 53 in the bottom base plate to match the standard holes 73 in the board 70 secured together by screws or bolts 10 screwed into the board holes 73.

In FIG. 1, the rotatable plate 30 is rotatably connected to the base plate by a cylindrical post 140 with an annular groove 145 extending downwardly from the rotatable plate 30 and the base plate 50 having a mating circular opening 51 for encircling the cylindrical post, and a C-shaped spring clip 146 for insertion in the annular groove 145 to hold the plates rotatably together. The C-shaped spring clip 146 is accommodated by a recessed groove 52 on the underside of the base plate around the center opening 51.

In FIG. 1, a cap plate 20 (shown dashed) secures the boot binding 60 to the rotatable plate 30 so that the boot binding and rotatable plate are rotatable relative to the base plate 50. The boot binding 60 has a circular opening therethrough and the cap plate 20 has an elevated peripheral rim 26 and a downwardly protruding circular bottom 28, smaller in diameter than the binding circular opening, so that the downwardly protruding circular bottom of the cap plate is capable of fitting into the mating circular opening (65) and contacting the rotatable plate 30 to which the cap plate is secured by bolts 21, or other attaching means in holes 143, while the elevated peripheral rim 26 of the cap plate 20 secures the boot binding 60 to the rotatable plate 30 by the interlocking of the top teeth 81 and bottom teeth 61 thereby locking the boot binding 60 to the rotatable plate 30.

Figure 9:
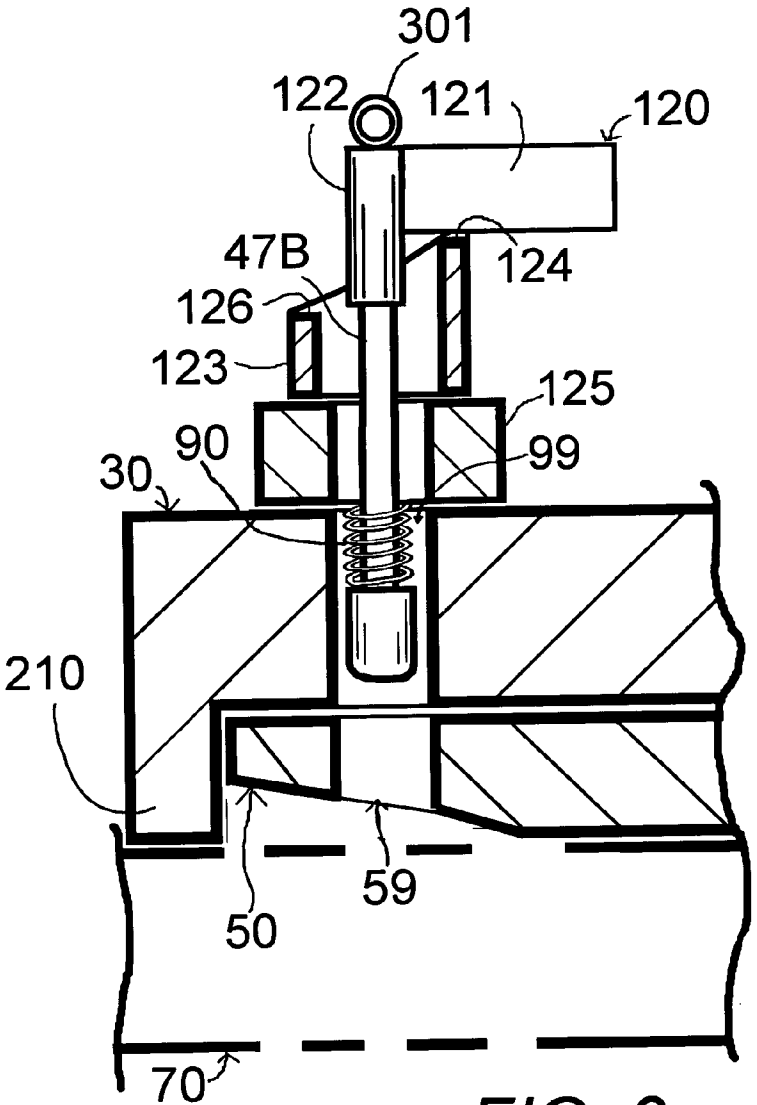
FIG. 9 is an enlarged partial cross-sectional view of the alternate embodiment of the locking mechanism of FIG. 8 with the handle engaged in a notch at the top of the angled rim, the spring in the compressed position, and the locking post elevated out of engagement with the base plate so that the rotatable plate may be freely rotated.
Figure 8:
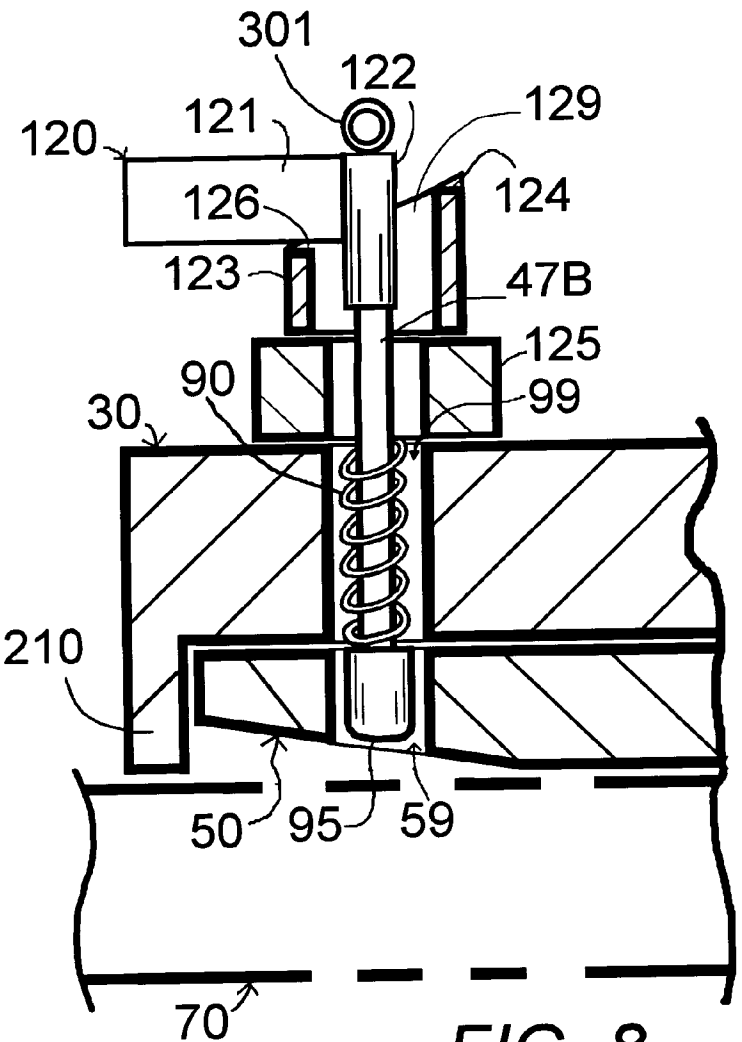
FIG. 8 is an enlarged partial cross-sectional view of a preferred embodiment of the locking mechanism with a downwardly biasing spring on a locking shaft with an L-shaped handle movable on an angled top rim of a sleeve and shown in the locked mode released spring position so that the handle is at the bottom of the angled top rim and the locking post downwardly engages the base plate to prevent rotation of the rotatable plate.

In FIGS. 1, 8 and 9, the rotatable board boot binding device has an L-shaped screw locking assembly 120 capable of locking in a down position (shown in FIG. 8) engaging both the base plate 50 and the rotatable plate 30 with the end of the locking shaft 95 through one of the lock holes 59 in the base plate 50, so that the rotatable plate 30 is secured to the base plate 50 to prevent rotation therebetween with the boot binding stationary at a desired angle of orientation to the board. L-shaped screw locking assembly 120 is further capable of locking in an up position (shown in FIG. 9) free of the base plate 50 to allow rotation between the rotatable plate 30 and the base plate 50 so that the board boot binding 60 is rotatable relative to the board 70 without holding the locking assembly 120 in an elevated position.

In FIGS. 8 and 9, locking assembly 120 comprises a solid sleeve 123 having an angled top rim with a notch opening 124 in a top of the angled rim and a V-configuration 126 at the bottom of the angled rim. The notch opening 124 comprises the upper shaft engaging means and the V-configuration 126 comprises the lower shaft engaging means and at least one lateral protrusion of the locking shaft comprises an L-shaped handle 122 with a flag-like arm 121 protruding laterally from the locking shaft, the arm 121 of the L-shaped handle capable of being secured alternately in the V-configuration 126, as seen in FIG. 8 with the locking shaft 95 engaged in one of the lock holes 59 of the base plate 50, and 5 slid upwardly along the angled rim and rotated 180 degrees in the notch opening 124 with the locking shaft 95 disengaged from the base plate 50 and the rotatable plate 30 free to rotate, as seen in FIG. 9.

In FIGS. 4–6, 8 and 9, the rotatable plate 30 further comprises a peripheral downwardly extending ridge 210, capable of overlapping the base plate 50 to prevent matter, such as snow and ice, from entering between the plates.

Figure 2:
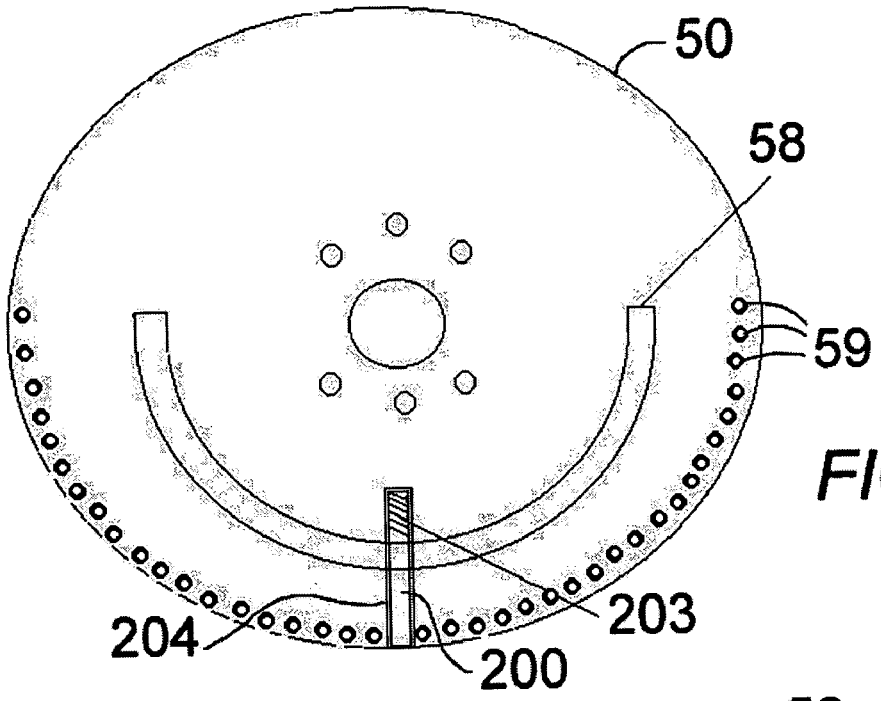
FIG. 2 is a top plan view of the base plate of the invention of FIG. 1.
Figure 3:
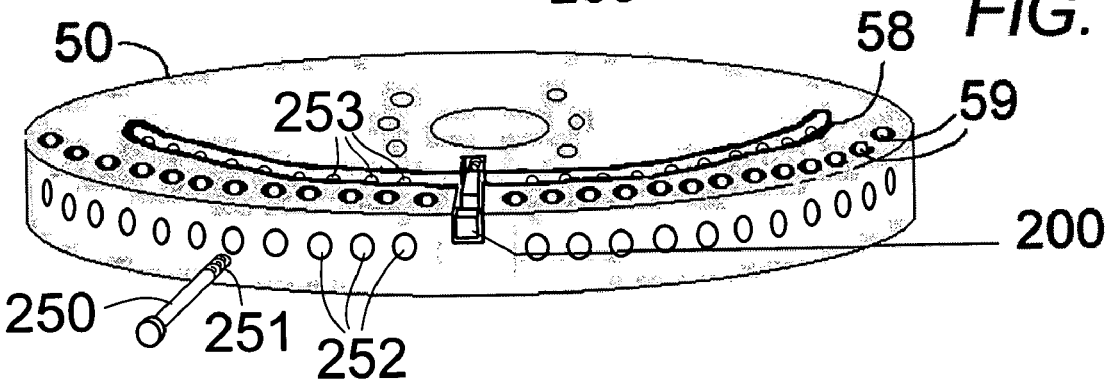
FIG. 3 is a perspective view of the base plate of the invention of FIG. 1 showing the opening for pressing in the sliding lock in the edge of the base plate.
Figure 4:
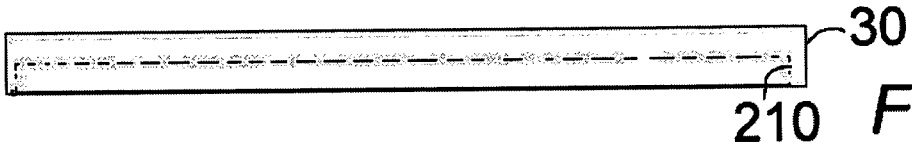
FIG. 4 is a side elevational view of the rotatable plate of the invention of FIG. 1 showing the downwardly extending edge around the perimeter for overhanging the base plate.
Figure 5:
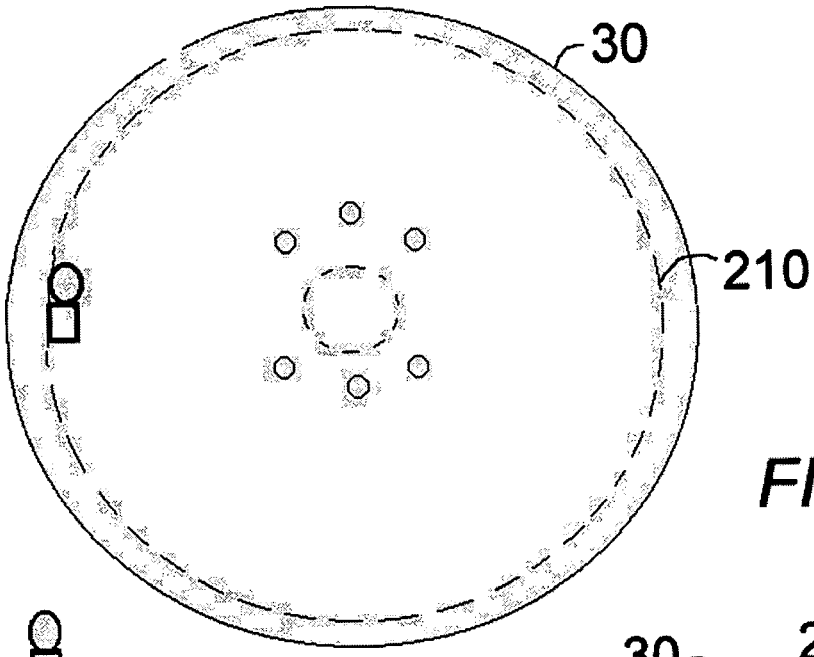
FIG. 5 is a top plan view of the rotatable plate of the invention of FIG. 1 showing the downwardly extending edge around the perimeter for overhanging the base plate.
Figure 6:
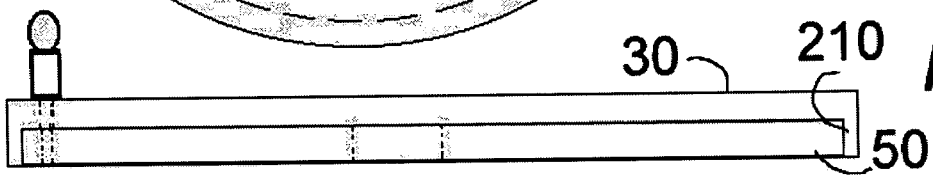
FIG. 6 is a cross-sectional view of the rotatable plate and base plate of the invention of FIG. 1 taken through the centerline of the plates showing the downwardly extending edge around the perimeter of the rotatable plate for overhanging the base plate and the locking mechanism from the rotatable plate locked down into one of the locking ring holes of the base plate.
Figure 7:
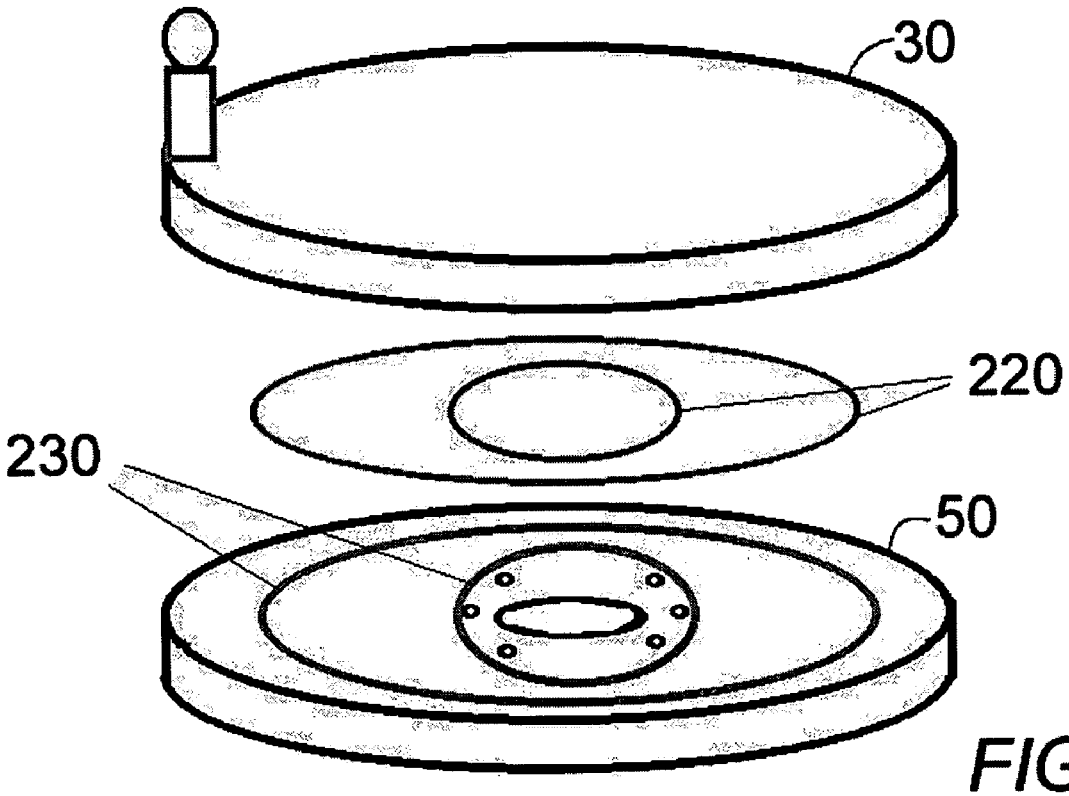
FIG. 7 is an exploded perspective view of the rotatable plate and the base plate with a Teflon® ring aligned for positioning in the circular grooves of the base plate.

In FIGS. 1–3, a safety device is incorporated in the base plate and the rotatable plate to limit the degree of relative rotation therebetween to permit the board boot to turn within a safe limit and prevent the board boot from turning beyond the safe limit. One of the pair of rigid plates has a groove 58, shown in the base plate 50, therein in the shape of an arc of a circle of preferably 180 degrees and the other of the pair of the rigid plates has a mating pin 18, shown in the rotatable plate 30, protruding downwardly therefrom, the pin 18 engaging the groove 58 and thereby limiting the degree of relative rotation of the rigid plates. A movable stop 200 is positionable within a slot 204 running transversely to the groove to divide the groove into at least two smaller arcs. The movable stop 200 is held by a spring 203 with a stop ridge 202 blocking the groove 58 thereby dividing the groove 58 into two smaller arcs, preferably of about 90 degrees each, so that the pin 18 is limited to rotating within a first smaller arc and alternately with the movable stop 200 moved by pushing in to displace the stop ridge 202 to allow the pin to relocate into a second smaller arc with the movable stop 200 repositioned with the stop ridge 202 in the groove so that the pin is limited to rotating within the second smaller arc. The groove 58 is preferably cut through the plate and the pin 18 may be formed with the other plate or welded or bolted on or otherwise attached. This safety feature prevents over-extension of the knee and ankle which might occur if the boot rotated too far. This permits a safe limit of free rotation of the boot while going downhill or performing any other activity. It also allows the rental companies the ability to change angles and basic foot orientation (0–90 or 90–180 degrees) for various riders very quickly and with relative ease.

In FIG. 1, an information bearing surface 31 is formed in the rotatable plate 30 on the side opposite to the lock mechanism 120. Information bearing surface 32 such as an advertising message with a name or phone number of the seller of the invention or the name of the owner of the board bearing information affixed thereon or by imprinting or inscribing or molding the information thereon.

In FIG. 1, a rotation position indicator pointer 500 preferably on the sleeve 123 of locking assembly 120 on the rotatable plate 30 capable of being used with a graduated sticker 501 on the board 70 to indicate the degree of rotation of the rotatable plate.

In FIG. 1, a cord, such as a flexible cord 300 having a hand grip or leg strap such as a top end loop 303 may be attached by a bottom hook 302 to a top ring 301 for attaching the cord on the locking shaft, so that the cord is capable of being grasped by a user to operate locking assembly 120 from a standing position.

In FIG. 1, an inner grease ring 600 keeps dirt out of the pivotable means between the two plates.

In FIG. 1, the base plate 50 is provided with a series of indented openings 40 land the a series of low friction elements, such as nylon pucks 400, are inserted in the series of indented openings 401 to reduce friction between the plates.

In FIGS. 8 and 9, the lock ring of holes 59 of the rotatable plate 50 is elevated above the board 70 to prevent icing of the locking holes 59.

In FIG. 3, the base plate 50 is provided with a series of angle set screw holes 252 around the periphery of the base plate 50 which angle set screws holes communicate between the periphery and the groove 58. At least one angle set screw 250 has end threads 251 which screw into mating threaded holes 253 in the wall of the groove 58 so that at least one angle set screw 250 is capable of being screwed into at least one of the holes so that the set screw protrudes into the groove 58 to create a stop for the pin 18 from the rotatable plate 30 to allow presetting of a desired amount of rotation between the plates.

The plates and shaft of the invention are preferably fabricated of a non-rust durable material, such as a non-rusting metal plate or structurally durable molded or injected plastic. The low-friction ring or pucks are preferably fabricated of a low-friction material such as Teflon®.

Although the present invention has been described in terms of the presently preferred embodiment for a snowboard, it is to be understood that such disclosure is purely illustrative and is not to be interpreted as limiting. Consequently, without departing from the spirit and scope of the invention, various alterations, modifications, and for alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention which is compatible for use in sky, ground, water, ice, and ski board sports and related extreme sports and preferably used with boards, skis, and comparable items including, for example, water and snow skis and snowboards, wakeboards, skateboards, surfboards, and sailboards, and skateboard-type devices adapted for use on ice surfaces.

What is claimed is:

1. A rotatable board boot binding attachment device for securing a sports board boot binding to a sports board and for permitting angular adjustment and alternate rotation and nonrotation of the board boot binding relative to the board, comprising:

a pair of rigid plates including a circular base plate adapted to be secured to the sports board and a rotatable plate for receiving the board boot binding to be secured thereto, the rotatable plate being positioned above the base plate and being rotatably connected to the base plate by a pivotable means, the rotatable plate being capable of coupling a board boot binding in a fixed position relative to the rotatable plate;

a locking assembly for locking the rotatable plate in selected positions of angular adjustment relative to the base plate and for selectively maintaining the rotatable plate in either a locked mode, in which the rotatable plate is prevented from rotating relative to the base plate or a released mode, in which the rotatable plate is free to rotate relative to the base plate, the locking assembly including a locking ring formed by a plurality of locking holes extending through a circumferential portion of the base plate, an opening extending through the rotatable plate and alignable with the locking holes in the selected positions of angular adjustment, and a locking shaft capable of alternating between a locked position extending through the opening of the rotatable plate into one of the plurality of locking holes in the base plate to retain the rotatable plate in the locked mode wherein rotation of the rotatable plate is prevented, and an unlocked position with the locking shaft retracted from the one of the plurality of locking holes in the base plate to put the rotatable plate in the released mode, thereby permitting angular adjustment of the board boot binding relative to the board;

a safety device incorporated in the base plate and the rotatable plate, the safety device capable of limiting the degree of relative rotation therebetween to permit the board boot to turn within a safe limit and prevent the board boot from turning beyond the safe limit, the safety device comprising one of the pair of rigid plates having a groove therein in the shape of an arc of a circle and the other of the pair of the rigid plates having a mating pin protruding therefrom, the pin engaging the groove and thereby limiting the degree of relative rotation of the rigid plates to the degree of the arc of the circular groove, and at least one movable stop positionable within the groove to divide the groove into at least two smaller arcs so that the pin is limited to rotating within at least one first smaller arc and alternately with the stop moved to allow the pin to relocate into at least one second smaller arc with the stop pin repositioned in the groove so that the pin is limited to rotating within the at least one second smaller arc.

2. The device of claim 1 wherein the pivotable means comprises one plate having a protruding cylindrical post with an annular groove and the other plate having a mating circular opening for encircling the cylindrical post, and a C-clamp for insertion in the annular groove to hold the plates rotatably together.

3. The device of claim 1 wherein the locking assembly further comprises a tension means for biasing the locking shaft toward the base plate and the locking shaft further comprises at least one lateral protrusion extending therefrom, a locking base attached to the rotatable plate, the locking base having a vertical opening therethrough to admit the locking shaft fitting slidably therein and the locking base further comprising an upper shaft engaging means for engaging the at least one lateral protrusion of the locking shaft in an upper position with the locking shaft disengaged from the base plate and a lower shaft engaging means for engaging the at least one lateral protrusion of the locking shaft in a lower position with the locking shaft engaging the base plate.

4. The device of claim 3 wherein the locking base comprises a solid sleeve having an angled top rim with a notch opening in the top of the angled rim and a V-configuration at the bottom of the angled rim, wherein the notch opening comprises the upper shaft engaging means and the V-configuration comprises the lower shaft engaging means and the at least one lateral protrusion of the locking shaft comprises an L-shaped handle protruding laterally from the locking shaft, the L-shaped handle capable of being secured alternately in the notch and the V-configuration.

5. The device of claim 1 further comprising at least one low friction element between the rotatable plate and the base plate to facilitate rotation therebetween.

6. The device of claim 5 wherein at least one of the plates further comprises at least one circular groove, on a face adjacent to the other of the plates and the at least one low friction element comprises at least one ring fabricated of low friction material, the at least one ring capable of fitting within the at least one circular groove to provide at least one low friction contact surface between the plates.

7. The device of claim 5 wherein one of the plates is provided with a series of indented openings and the at least one low friction element comprises a series of low friction elements capable of being inserted in the series of indented openings.

8. The device of claim 1 wherein the rotatable plate further comprises a smooth information surface capable of displaying information thereon visible on the top of the rotatable plate.

9. The device of claim 1 further comprising a rotation position indicator pointer on the rotatable plate capable of being used with a graduated sticker on the board to indicate the degree of rotation of the rotatable plate.

10. The device of claim 1 further comprising a cord capable of being attached to the locking shaft so that the cord is capable of being grasped by a user to operate the locking assembly from a standing position and the locking assembly further comprises a means for attaching the cord.

11. The device of claim 10 wherein the locking shaft is provided with a top ring which comprises the for attaching the cord means.

12. The device of claim 1 wherein the rotatable plate further comprises a peripheral downwardly projecting ridge that overlaps the base plate to keep dirt out from between the plates.

13. The device of claim 1 further comprising an inner grease ring to keep dirt out of the pivotable means between the two plates.

14. The device of claim 1 wherein the locking ring is elevated above the board to prevent water and ice from collecting in the locking holes.

15. The device of claim 1 wherein the one of the pair of rigid plates having the groove is provided with a series of angle set screw holes around the periphery of the one of the pair of rigid plates which angle set screws holes communicate between the periphery and the groove so that the at least one angle set screw is capable of being screwed in at least one of the holes so that the set screw protrudes into the groove to create a stop for the pin to allow presetting of the amount of rotation between the plates.

* * * * *